US010995714B2

(12) United States Patent
Sato et al.

(10) Patent No.: US 10,995,714 B2
(45) Date of Patent: May 4, 2021

(54) OUTBOARD MOTOR

(71) Applicant: YAMAHA HATSUDOKI KABUSHIKI KAISHA, Iwata (JP)

(72) Inventors: Hiroki Sato, Shizuoka (JP); Akihiro Noma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 164 days.

(21) Appl. No.: 16/041,861

(22) Filed: Jul. 23, 2018

(65) Prior Publication Data

US 2019/0226436 A1 Jul. 25, 2019

(30) Foreign Application Priority Data

Jan. 25, 2018 (JP) ..... JP2018-010735

(51) Int. Cl.

| | |
|---|---|
| ***F02M 37/20*** | (2006.01) |
| ***F02D 41/30*** | (2006.01) |
| ***F02D 41/06*** | (2006.01) |
| ***B63H 20/00*** | (2006.01) |
| ***F02B 61/04*** | (2006.01) |

(Continued)

(52) U.S. Cl.

CPC ..... *F02M 37/20* (2013.01); *B63H 20/001* (2013.01); *F02B 61/045* (2013.01); *F02D 41/062* (2013.01); *F02D 41/3082* (2013.01); *F02D 41/38* (2013.01); *F02M 37/06* (2013.01); *F02M 37/22* (2013.01); *F02D 41/042* (2013.01); *F02D 2041/224* (2013.01); *F02D 2041/228* (2013.01);

(Continued)

(58) Field of Classification Search

CPC ..... F02M 37/20; F02M 37/22; F02M 37/06; F02M 63/0285; F02D 41/3082; F02D 41/062; F02D 41/38; F02D 2041/224; F02D 2041/228; F02D 41/042; F02D 2041/389; B63H 20/001; F02B 61/045

USPC ..... 701/21, 107

See application file for complete search history.

(56) References Cited

U.S. PATENT DOCUMENTS

| | | | |
|---|---|---|---|
| 5,927,253 A | 7/1999 | Oyafuso et al. | |
| 7,216,614 B2 * | 5/2007 | Shibata | F02D 33/006 123/179.17 |

(Continued)

FOREIGN PATENT DOCUMENTS

| | | |
|---|---|---|
| FR | 2 864 163 A1 | 6/2005 |
| JP | 07-14159 U | 3/1995 |

OTHER PUBLICATIONS

English Translation: Bubel et al., French Patent Publication No. FR 2864163 A1, Jun. 2005, French Patent Office Publication (Year : 2005).*

*Primary Examiner* — Nadeem Odeh

(74) *Attorney, Agent, or Firm* — Keating and Bennett, LLP

(57) ABSTRACT

An outboard motor includes an engine, a fuel tank, a fuel pathway, a fuel pump, and a controller. The engine includes a fuel injector. The fuel tank includes an internal space in which fuel is stored. The fuel pathway is connected to the fuel injector and the fuel tank. The fuel pump is disposed in the fuel pathway, and supplies the fuel from the fuel tank to the fuel injector. The controller controls the fuel pump. The controller determines whether or not a start condition, indicating that air has entered the fuel pathway, is satisfied. The controller is configured or programmed to execute an air releasing control to open the fuel injector and drive the fuel pump when the start condition is satisfied.

11 Claims, 5 Drawing Sheets

(51) Int. Cl.

| | |
|---|---|
| ***F02D 41/38*** | (2006.01) |
| ***F02M 37/22*** | (2019.01) |
| ***F02M 37/06*** | (2006.01) |
| *F02M 63/02* | (2006.01) |
| *F02D 41/22* | (2006.01) |
| *F02D 41/04* | (2006.01) |

(52) U.S. Cl.
CPC ... *F02D 2041/389* (2013.01); *F02M 63/0285* (2013.01)

(56) References Cited

U.S. PATENT DOCUMENTS

| | | | | |
|---|---|---|---|---|
| 2004/0211395 | A1 | 10/2004 | Greco et al. | |
| 2008/0314349 | A1 | 12/2008 | Oertel et al. | |
| 2010/0031931 | A1* | 2/2010 | Hirose | F02M 25/0836 123/516 |

* cited by examiner

OUTBOARD MOTOR

CROSS REFERENCE TO RELATED APPLICATIONS

This application claims the benefit of priority to Japanese Patent Application No. 2018-010735 filed on Jan. 25, 2018. The entire contents of this application are hereby incorporated herein by reference.

BACKGROUND OF THE INVENTION

1. Field of the Invention

The present invention relates to an outboard motor.

2. Description of the Related Art

An engine for an outboard motor is connected to a fuel tank through a fuel pathway such as a hose. The fuel pathway is provided with a fuel pump, and the fuel pump supplies fuel from the fuel tank to the engine through the fuel pathway. For example, Japan Utility Model Application Publication No. H07-14159 discloses an internal combustion engine in which a fuel tank and a fuel pump are connected through piping, and the fuel pump and fuel injection devices are connected through a delivery pipe.

Air possibly enters the fuel pathway in such a situation that the fuel runs out or that the fuel pump is replaced. When air enters the fuel pathway, it takes time to supply the fuel to the engine. As a result, it inevitably takes time to start the engine. In view of this, it has been demanded to improve an outboard motor so as to easily start the engine even in such a situation.

SUMMARY OF THE INVENTION

Preferred embodiments of the present invention provide outboard motors each including an engine, a fuel tank, a fuel pathway, a fuel pump, and a controller. The engine includes a fuel injector. The fuel tank includes an internal space in which fuel is stored. The fuel pathway is connected to the fuel injector and the fuel tank. The fuel pump is disposed in the fuel pathway, and supplies the fuel from the fuel tank to the fuel injector. The controller controls the fuel pump. The controller is configured or programmed to determine whether or not a start condition, indicating that air has entered the fuel pathway, is satisfied. The controller is further configured or programmed to execute an air releasing control to open the fuel injector and drive the fuel pump when the start condition is satisfied.

According to a preferred embodiment of the present invention, when the air has entered the fuel pathway, the controller is configured or programmed to determine that the start condition is satisfied. Then, the controller opens the fuel injector and drives the fuel pump. Accordingly, the air is discharged from the fuel pathway, and starting of the engine is easier.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
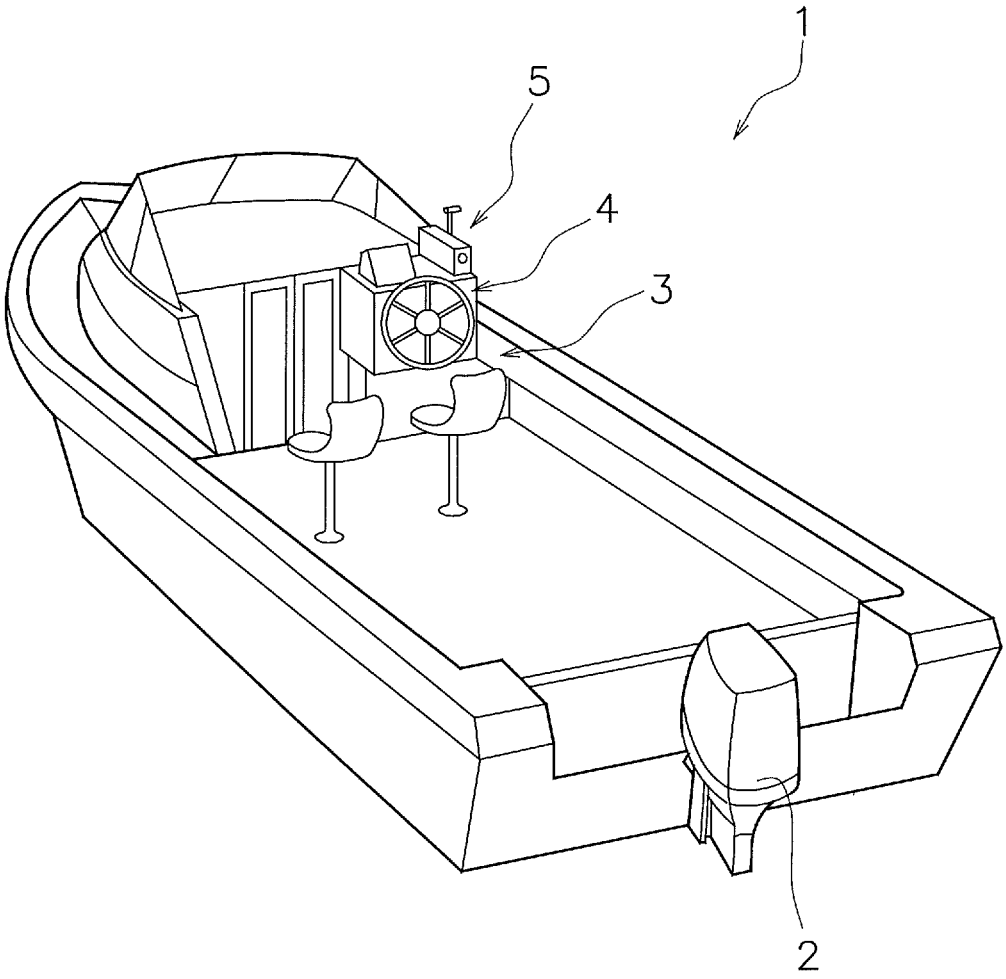
FIG. 1 is a perspective view of a watercraft to which an outboard motor according to a preferred embodiment of the present invention is mounted.

Preferred embodiments of the present invention will be hereinafter explained with reference to the drawings. FIG. 1 is a perspective view of a watercraft 1 to which an outboard motor 2 according to a preferred embodiment of the present invention is mounted. The outboard motor 2 is attached to the stern of the watercraft 1. The outboard motor 2 generates a thrust to propel the watercraft 1. In the present preferred embodiment, the single outboard motor 2 is mounted to the watercraft 1, but alternatively, two or more outboard motors 2 may be mounted to the watercraft 1.

The watercraft 1 includes a cockpit 3. A steering member 4 and a remote control 5 are disposed in the cockpit 3. The steering member 4 allows an operator to steer and control the traveling direction of the watercraft 1. The remote control 5 allows the operator to regulate the velocity of the watercraft 1. The remote control also allows the operator to switch between forward movement and backward movement of the watercraft 1.

Figure 2:
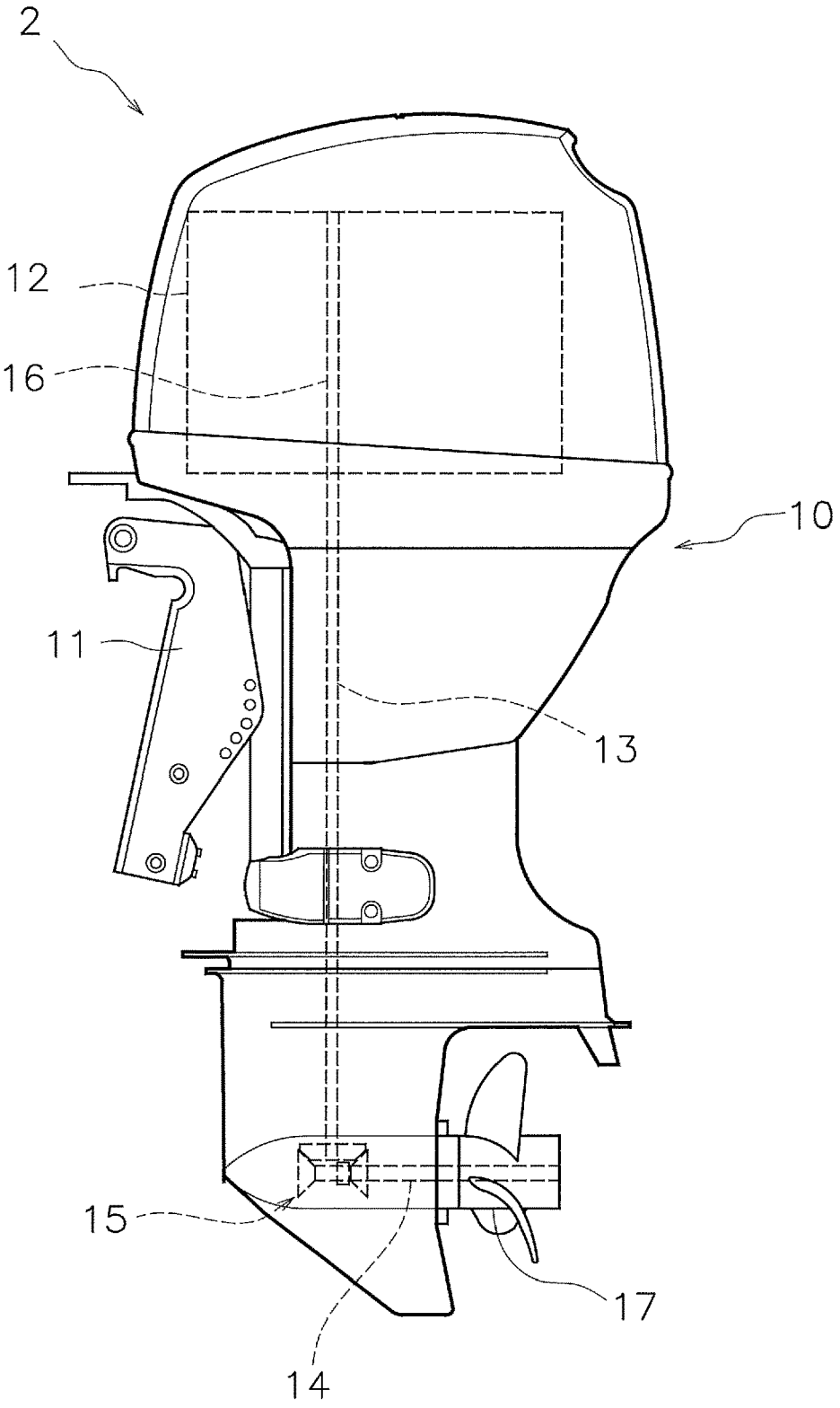
FIG. 2 is a side view of the outboard motor.

FIG. 2 is a side view of the outboard motor 2. The outboard motor 2 includes an outboard motor body 10 and a bracket 11. The outboard motor body 10 is attached to the watercraft 1 through the bracket 11. The outboard motor body 10 includes an engine 12, a driveshaft 13, a propeller shaft 14, and a shift mechanism 15.

The engine 12 generates the thrust to propel the watercraft 1. The engine 12 is preferably a direct injection engine, for example. The engine 12 includes a crankshaft 16. The crankshaft 16 extends in the vertical direction. The driveshaft 13 is connected to the crankshaft 16. The driveshaft 13 extends in the vertical direction. The propeller shaft 14 extends in the front-and-back direction. The propeller shaft 14 is connected to the driveshaft 13 through the shift mechanism 15. A propeller 17 is connected to the propeller shaft 14.

The shift mechanism 15 switches the rotational direction of power transmitted from the driveshaft 13 to the propeller shaft 14. For example, the shift mechanism 15 includes a plurality of gears and a clutch that changes meshing of the gears.

Figure 3:
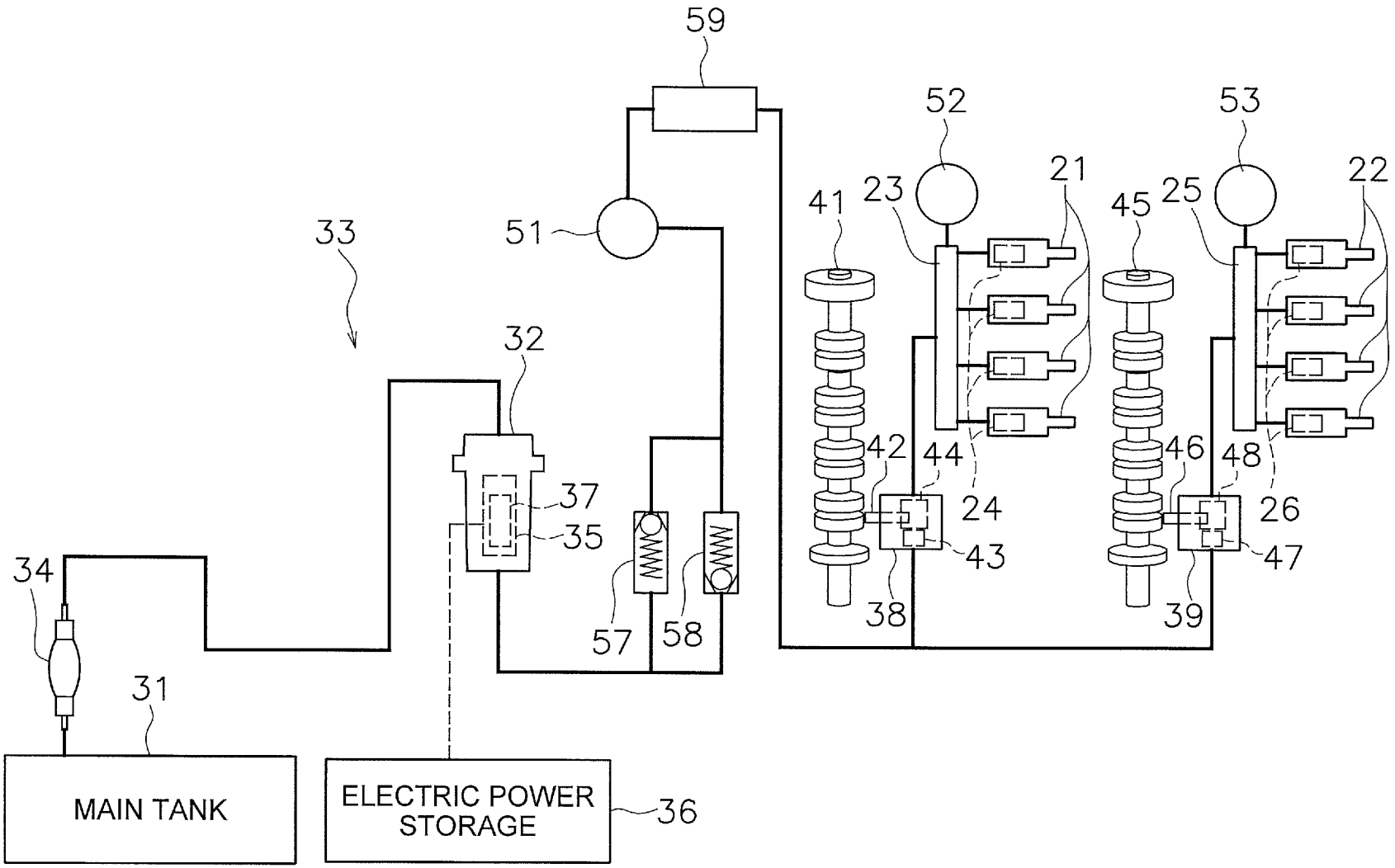
FIG. 3 is a schematic diagram of a fuel supply system of the outboard motor.

FIG. 3 is a schematic diagram of a fuel supply system of the outboard motor 2. As shown in FIG. 3, the engine 12 of the outboard motor 2 includes a plurality of fuel injectors 21 and 22. More specifically, the engine 12 includes a plurality of first fuel injectors 21 and a plurality of second fuel injectors 22. The plurality of first fuel injectors 21 are connected to a first common rail 23. Each first fuel injector 21 includes an electromagnetic valve 24. The electromagnetic valve 24 opens and closes the injection port of each first fuel injector 21. Each first fuel injector 21 injects fuel into a combustion chamber of the engine 12 while the electromagnetic valve 24 thereof is open.

The plurality of second fuel injectors 22 are connected to a second common rail 25. Each second fuel injector 22 includes an electromagnetic valve 26. The electromagnetic valve 26 opens and closes the injection port of each second fuel injector 22. Each second fuel injector 22 injects fuel into the combustion chamber of the engine 12 while the electromagnetic valve 26 thereof is open.

The fuel supply system of the outboard motor 2 includes a main tank 31, a fuel tank 32, and a fuel pathway 33. The main tank 31 includes an internal space in which the fuel is stored. The main tank 31 is disposed inside the watercraft 1. The fuel pathway 33 connects the main tank 31 and the first and second fuel injectors 21 and 22 to each other. The fuel pathway 33 is, for instance, a hose. It should be noted that the fuel pathway 33 may be a pipe. The fuel supply system of the outboard motor 2 supplies the fuel from the main tank 31 to the first and second fuel injectors 21 and 22.

The fuel tank 32 includes an internal space in which the fuel is stored. The fuel tank 32 is disposed inside the outboard motor 2. The fuel tank 32 is disposed between the main tank 31 and the first and second fuel injectors 21 and 22 in the fuel pathway 33. The fuel tank 32 is a vapor separator tank that separates fuel and air from each other.

The outboard motor 2 includes a primary pump 34 and a fuel pump 35. The primary pump 34 is disposed between the main tank 31 and the fuel tank 32 in the fuel pathway 33. The primary pump 34 supplies the fuel in response to a manual operation.

The fuel pump 35 is disposed inside the fuel tank 32. The fuel pump 35 is connected to an electric power storage 36, and is driven by electric power. The electric power storage 36 is, for instance, a battery. The fuel pump 35 includes an electric motor, for instance, and supplies the fuel when the electric motor is driven by the electric power from the electric power storage 36.

Additionally, a sub pump 37 is disposed inside the fuel tank 32. Similarly to the fuel pump 35, the sub pump 37 is connected to the electric power storage 36, and is driven by electric power. The sub pump 37 includes an electric motor, for instance, and supplies the fuel when the electric motor is driven by the electric power from the electric power storage 36.

The outboard motor 2 includes a first direct injection pump (hereinafter referred to as "a first DI pump") 38 and a second direct injection pump (hereinafter referred to as "a second DI pump") 39. The first DI pump 38 is disposed between the first fuel injectors 21 and the fuel tank 32. The first DI pump 38 supplies the fuel to the first fuel injectors 21 through the first common rail 23. The first DI pump 38 is connected to the crankshaft 16 through a first camshaft 41. The first camshaft 41 is connected to the crankshaft 16, and is rotated in conjunction with rotation of the crankshaft 16.

The first DI pump 38 includes a plunger 42, an electromagnetic valve 43, and a compression chamber 44. When pressed by a cam of the first camshaft 41, the plunger 42 compresses the fuel inside the compression chamber 44 of the first DI pump 38. The electromagnetic valve 43 opens and closes the inlet of the compression chamber 44 of the first DI pump 38. When the plunger 42 compresses the fuel inside the compression chamber 44 while the inlet of the compression chamber 44 is closed by the electromagnetic valve 43, the fuel is increased in pressure and is supplied from the first DI pump 38.

The second DI pump 39 is connected to the crankshaft 16 through a second camshaft 45. The second camshaft 45 is connected to the crankshaft 16, and is rotated in conjunction with rotation of the crankshaft 16. The second DI pump 39 is disposed between the second fuel injectors 22 and the fuel tank 32. The second DI pump 39 supplies the fuel to the second fuel injectors 22 through the second common rail 25. The second DI pump 39 includes a plunger 46, an electromagnetic valve 47, and a compression chamber 48. The second DI pump 39 preferably has a similar structure to the first DI pump 38.

The outboard motor 2 includes a low pressure sensor 51, a first high pressure sensor 52, and a second high pressure sensor 53. The low pressure sensor 51 is disposed between the fuel tank 32 and the first and second DI pumps 38 and 39 in the fuel pathway 33. The first high pressure sensor 52 is disposed between the first DI pump 38 and the first fuel injectors 21 in the fuel pathway 33. The second high pressure sensor 53 is disposed between the second DI pump 39 and the second fuel injectors 22 in the fuel pathway 33. Each of the low pressure sensor 51, the first high pressure sensor 52, and the second high pressure sensor 53 outputs a signal indicating a detected value of the pressure of the fuel.

It should be noted that check valves 57 and 58 and a strainer 59 may be disposed between the fuel tank 32 and the first and second DI pumps 38 and 39 in the fuel pathway 33.

Figure 4:
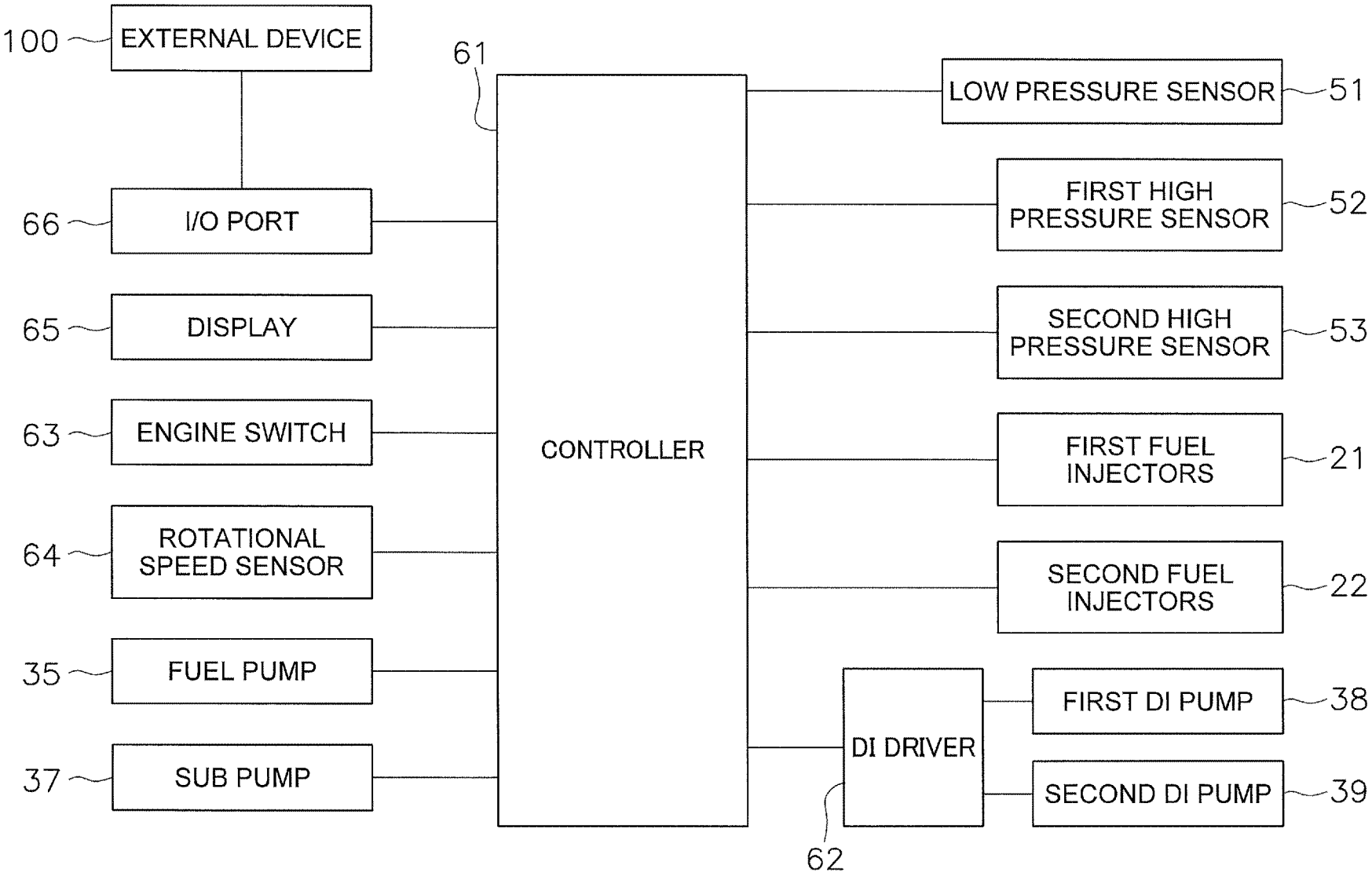
FIG. 4 is a block diagram of a control system of the outboard motor.

FIG. 4 is a block diagram of a control system of the outboard motor 2. As shown in FIG. 4, the outboard motor 2 includes a controller 61. The controller 61 includes a processor such as a CPU and memories such as a RAM and a ROM. The controller 61 stores a program or programs and data used to control the outboard motor 2. The controller 61 is in communication with the remote control 5, and controls the engine 12 and the shift mechanism 15 in response to signals from the remote control 5, although this configuration is omitted in FIG. 4.

The controller 61 is in communication with the low pressure sensor 51, the first high pressure sensor 52, and the second high pressure sensor 53. The controller 61 is configured or programmed to receive signals from the low pressure sensor 51, the first high pressure sensor 52, and the second high pressure sensor 53, respectively.

The controller 61 is in communication with the fuel pump 35 and the sub pump 37. The controller 61 controls the fuel pump 35 and the sub pump 37 by outputting command signals to the fuel pump 35 and the sub pump 37, respectively. More specifically, the controller 61 controls the discharge pressure of the fuel pump 35 and that of the sub pump 37 by PWM control, for example.

The controller 61 is in communication with the first and second DI pumps 38 and 39 through a direct injection driver (hereinafter referred to as "a DI driver") 62, for example. The controller 61 controls the first and second DI pumps 38 and 39 by outputting command signals to the first and second DI pumps 38 and 39, respectively, through the DI driver 62. More specifically, the controller 61 opens and closes the inlet of the compression chamber 44 of the first DI pump 38 and that of the compression chamber 48 of the second DI pump 39 by outputting command signals to the electromagnetic valve 43 of the first DI pump 38 and the electromagnetic valve 47 of the second DI pump 39, respectively.

The controller 61 is in communication with the first fuel injectors 21 and the second fuel injectors 22. The controller 61 controls the first fuel injectors 21 and the second fuel injectors 22 by outputting command signals to the first fuel injectors 21 and the second fuel injectors 22, respectively. More specifically, the controller 61 opens and closes the first fuel injectors 21 and the second fuel injectors 22 by outputting command signals to the electromagnetic valves 24 of the first fuel injectors 21 and the electromagnetic valves 26 of the second fuel injectors 22, respectively.

The outboard motor 2 includes an engine switch 63. The engine switch 63 is in communication with the controller 61. The engine switch 63 is switchable between an off position and an on position. The engine switch 63 outputs a signal indicating the position thereof to the controller 61.

When the engine switch 63 is set in the on position, the controller 61 permits starting the engine 12 or starts the engine 12. When the engine switch 63 is set in the off position, the controller 61 prohibits starting the engine 12 or stops the engine 12.

The outboard motor 2 includes a rotational speed sensor 64. The rotational speed sensor 64 outputs a signal indicating the rotational speed of the engine 12. The rotational speed sensor 64 is in communication with the controller 61. The controller 61 receives the signal from the rotational speed sensor 64.

The outboard motor 2 includes a display 65 as an output, for example. The display 65 is in communication with the controller 61. The display 65 receives a command signal from the controller 61 and displays a variety of information.

The outboard motor 2 includes an input/output (I/O) port 66. A signal from an external device 100 is inputted to the I/O port 66. The controller 61 receives the signal from the external device 100 through the I/O port 66. Additionally, the controller 61 outputs a signal to the external device 100 through the I/O port 66. For example, the external device 100 is, for example, a computing device such as a personal computer, a smart phone, or a tablet computer. The I/O port 66 may be an arbitrary interface as long as it is connectable to the external device 100.

It should be noted that the above communications between the components of the outboard motor 2 and the controller 61 may be wired communications, or alternatively, may be wireless communications.

Figure 5:
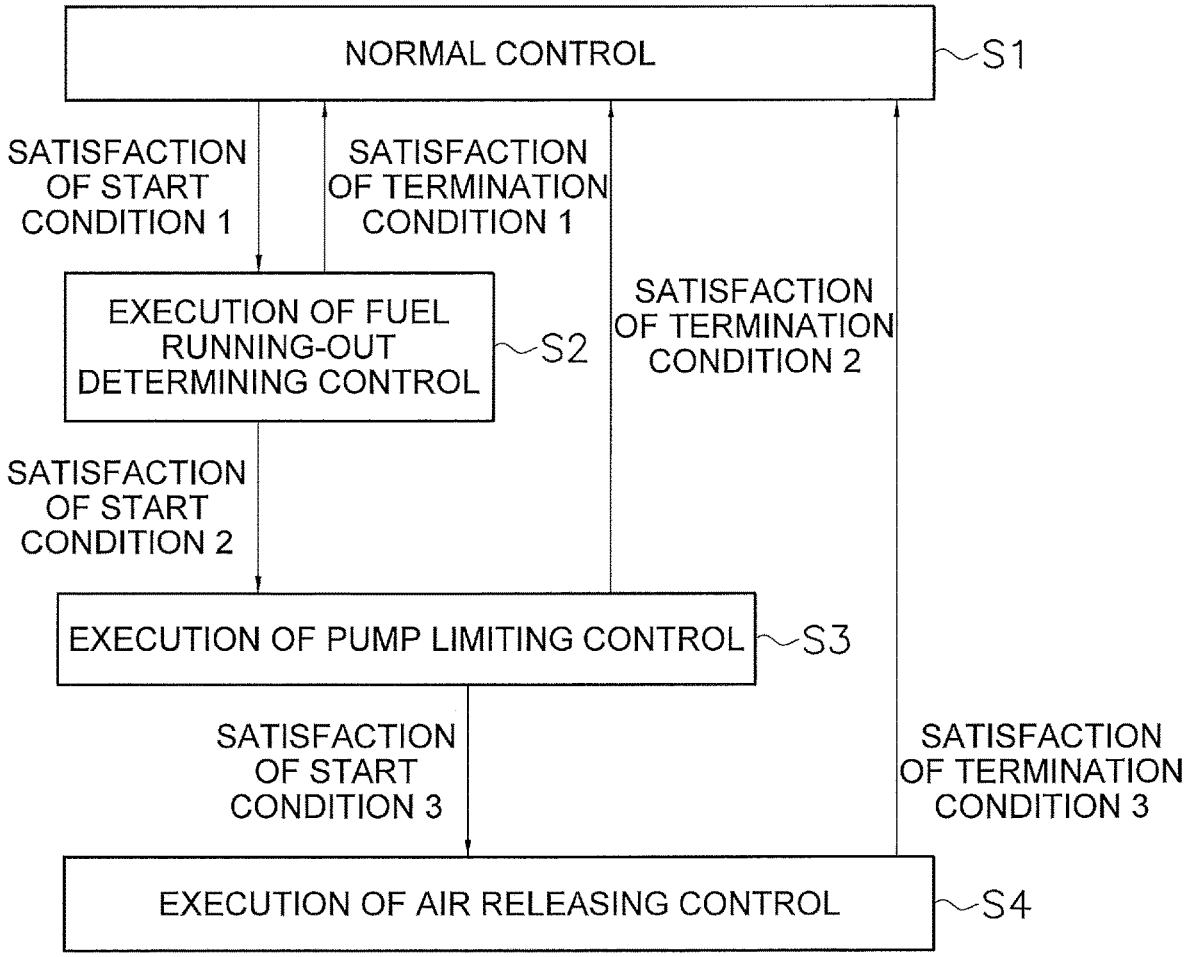
FIG. 5 is a chart showing control to be executed by a controller.

Next, explanation will be provided for the control to be executed when air enters the fuel pathway 33 in order to release the air therefrom. FIG. 5 is a chart showing a series of processes to be executed by the controller 61.

First, in step S1, air has not entered the fuel pathway 33 yet, and hence, the controller 61 executes normal control. During the normal control, the controller 61 obtains a value of the discharge pressure of the fuel pump 35, and executes feedback control so as to make the value of the discharge pressure approach a predetermined target value. The controller 61 obtains the value of the discharge pressure of the fuel pump 35 from the signal received from the low pressure sensor 51. The target value of the discharge pressure of the fuel pump 35 is set in accordance with, for instance, an operational condition of the outboard motor 2.

During the normal control, the controller 61 determines whether or not a start condition 1 is satisfied. The start condition 1 includes, for example, that the output of the fuel pump 35 has been kept at a maximum for a predetermined period of time. For example, the output of the fuel pump 35 corresponds to a command value transmitted to the fuel pump 35. The start condition 1 also means that the discharge pressure of the fuel pump 35 has been reduced and has not reached the target value yet. When the start condition 1 is satisfied, the controller 61 executes the process in step S2.

In step S2, the controller 61 executes a fuel running-out determining control. In the fuel running-out determining control, the controller 61 drives the sub pump 37, and simultaneously, determines whether or not a start condition 2 is satisfied. The start condition 2 includes, for example, that the output of the fuel pump 35 has been kept at a maximum. The start condition 2 also means that a reduction in the discharge pressure of the fuel pump 35 is not due to malfunction/breakdown of the fuel pump 35. When the start condition 2 is satisfied, the controller 61 executes the process in step S3.

It should be noted that when a termination condition 1 is satisfied during the fuel running-out determining control, the controller 61 terminates the fuel running-out determining control, and returns to the normal control. The termination condition 1 includes, for example, that the output of the fuel pump 35 has been reduced. The termination condition 1 also means that a reduction in the discharge pressure of the fuel pump 35 is due to malfunction/breakdown of the fuel pump 35.

In step S3, the controller 61 executes a pump limiting control. During the pump limiting control, the controller 61 lowers the upper limit of the output of the fuel pump 35. When a termination condition 2 is satisfied during the pump limiting control, the controller 61 terminates the pump limiting control and returns to the normal control. The termination condition 2 includes, for example, that the discharge pressure of each of the first and second DI pumps 38 and 39 has been kept greater than or equal to a minimum target value for a predetermined period of time. The termination condition 2 also means that fuel supply to the fuel injectors 21 and 22 has been recovered.

Additionally, during the pump limiting control, the controller 61 determines whether or not a start condition 3 is satisfied. The start condition 3 includes, for example, that engine stalling has occurred or that the engine switch 63 is set in the off position. In other words, the start condition 3 means that the engine 12 is being stopped or is stopped. The controller 61 determines whether or not engine stalling has occurred based on the signal received from the rotational speed sensor 64. The controller 61 determines whether or not the engine switch 63 is set in the off position based on the signal received from the engine switch 63.

When the start condition 3 is satisfied, the controller 61 executes the process in step S4. In step S4, the controller 61 executes an air releasing control. During the air releasing control, the controller 61 opens the first and second fuel injectors 21 and 22 and, simultaneously, drives the fuel pump 35. More specifically, the controller 61 outputs command signals to the electromagnetic valves 24 and 26, respectively, in order to intermittently open and close the first and second fuel injectors 21 and 22. The controller 61 may open and close all of the plurality of first fuel injectors 21 and all of the plurality of second fuel injectors 22. Alternatively, the controller 61 may open and close only some of the plurality of first fuel injectors 21 and only some of the plurality of second fuel injectors 22.

It should be noted that the electromagnetic valves 43 and 47 of the first and second DI pumps 38 and 39 are open. Additionally, the controller 61 drives the fuel pump 35 such that the discharge pressure of the fuel pump 35 becomes a predetermined target value. The target value of the discharge pressure during the air releasing control may be the same as or different from that of the discharge pressure in the above-described normal control. Additionally, the controller 61 may prohibit starting of the engine 12 during execution of the air releasing control. Accordingly, driving of the first and second DI pumps 38 and 39 is prohibited.

The controller 61 displays an alert on the display 65 during execution of the air releasing control. The alert includes, for example, a message encouraging a user to check the fuel pathway 33 and/or a message indicating that the engine 12 cannot be restarted immediately after being stopped. Additionally, the alert may include, for example, a message indicating that at least one task is required to start the engine 12. The at least one task required to start the engine 12 may include, for instance, executing cranking a plurality of times until start of the engine 12 and/or executing an idling operation after starting the engine 12.

It should be noted that some of the above-described messages may be changed or omitted. Alternatively, a message different from the above-described messages may be added to the alert. The alert is not necessarily made in the form of written messages, and alternatively, may be made in the form of icons. When the outboard motor 2 includes a speaker as an output, the alert may be in the form of sound. When the outboard motor 2 includes a warning light as an output, the alert may be in the form of lighting the alarm light.

During the air releasing control, the controller 61 determines whether or not a termination condition 3 is satisfied. The termination condition 3 includes, for example, that a predetermined period of time has elapsed since a start of the air releasing control. When the termination condition 3 is satisfied, the controller 61 terminates the air releasing control and returns to the normal control.

In the outboard motor 2 according to a preferred embodiment of the present invention, the controller 61 is configured or programmed to execute the air releasing control when the start conditions 1 to 3 are satisfied. The start conditions 1 and 2 indicate that air has entered the fuel pathway 33 due to the running out of the fuel. The start condition 3 indicates that the engine 12 is being stopped or is stopped.

When air has entered and remained in the fuel pathway 33 and, simultaneously, when the engine 12 is being stopped, the supply of fuel to the fuel injectors 21 and 22 is difficult, and it inevitably takes time to start the engine 12. Additionally, even when the user tries to supply the fuel to the engine 12 with the primary pump 34, the fuel is inevitably pushed back by the pressure of air in the fuel tank 32. Consequently, when air has entered and remained in the fuel pathway 33, it is difficult to supply the fuel to the engine 12 with the primary pump 34.

In such a situation as described above, the air releasing control is executed by the controller 61 in the outboard motor 2. During the air releasing control, the first and second fuel injectors 21 and 22 are intermittently opened and closed, and simultaneously, the fuel pump 35 is driven. Accordingly, the air, which has entered and remained in the fuel pathway 33, is discharged therefrom. As a result, starting of the engine 12 is easier.

Additionally, during the air releasing control, the engine 12 is kept stopped. Hence, driving of the plungers 42 and 46 is held back or delayed in the first and second DI pumps 38 and 39. Accordingly, reverse flow of the fuel due to driving of the plungers 42 and 46 is prevented.

Furthermore, during the air releasing control, the alert is displayed on the display 65. Therefore, the user is able to recognize that the air releasing control is being performed, and also, easily understand an action to be taken.

Preferred embodiments of the present invention have been explained above. However, the present invention is not limited to the above-described preferred embodiments, and a variety of changes can be made without departing from the gist of the present invention.

Some of the above-described components of the outboard motor 2 may be changed or omitted. Some of the above-described components of the fuel supply system may be changed or omitted. Some of the above-described controls may be changed or omitted.

The number of the fuel injectors is not limited to that of the above-described preferred embodiments, and may be changed. The number of the fuel injectors is not limited to a plurality, and alternatively, may be one. The number of the DI pumps is not limited to two, and alternatively, may be one or more than two. The engine is not limited to the direct injection type, and alternatively, may be of another type. The fuel tank is not limited to the vapor separator type, and alternatively, may be of another type.

The above-described start conditions 1 to 3 and termination conditions 1 to 3 may be changed or omitted. A single or plurality of conditions, different from the above-described start conditions 1 to 3 and termination conditions 1 to 3, may be additionally provided. For example, the start conditions may include a condition that the signal from the external device 100 has been inputted to the I/O port 66. The external device 100 may be a computer in which software for maintenance of the outboard motor 2 has been installed.

Air possibly enters the fuel pathway 33, for instance, immediately after the outboard motor 2 is assembled for manufacture or repair, or when the user reassembles the fuel supply system. In such a situation, the air releasing control may be executed by inputting a command signal to execute the air releasing control from the external device 100 to the I/O port 66 of the outboard motor 2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
- an engine including a fuel injector;
- a fuel tank including an internal space in which fuel is stored;
- a fuel pathway connected to the fuel injector and the fuel tank;
- a fuel pump disposed in the fuel pathway and that supplies fuel from the fuel tank to the fuel injector; and
- a controller configured or programmed to:
  - control the fuel pump;
  - determine whether or not a start condition, indicating that air has entered the fuel pathway, is satisfied; and
  - execute an air releasing control to open the fuel injector and drive the fuel pump when the start condition is satisfied; wherein
- the fuel tank is a vapor separator tank that is disposed between a main tank and the fuel injector; and
- the start condition includes determining that running out of the fuel has been detected in the fuel pathway and that stopping of the engine has been detected.

2. The outboard motor according to claim 1, wherein the controller is further configured or programmed to prohibit starting of the engine during the execution of the air releasing control.

3. The outboard motor according to claim 1, further comprising:
- an output that outputs an alert; wherein
- the output includes a display, a speaker, or a light; and
- the controller is further configured or programmed to cause the output to output the alert when the air releasing control is executed in response to the running out of the fuel.

4. The outboard motor according to claim 1, further comprising:
- a display connected to the controller; wherein
- the controller is further configured or programmed to cause the display to display at least one task required to start the engine when the air releasing control is executed in response to the running out of the fuel.

5. The outboard motor according to claim 4, wherein the at least one task required to start the engine includes at least one of executing cranking until the engine is started and an instruction to be performed after the engine is started and the instruction includes executing an idling operation after the engine is started.

6. The outboard motor according to claim 1, wherein the engine is a direct injection engine including a crankshaft; and the outboard motor further comprises a direct injection pump connected to the crankshaft and that supplies the fuel to the fuel injector.

7. The outboard motor according to claim 1, wherein the vapor separator tank separates the fuel and air in the vapor separator tank from each other.

8. The outboard motor according to claim 1, further comprising:

a primary pump disposed in the fuel pathway and that supplies the fuel in response to a manual operation.

9. The outboard motor according to claim 1, further comprising:

an input port to which a signal from an external device is inputted; wherein the start condition includes determining that the signal from the external device has been inputted to the input port.

10. The outboard motor according to claim 1, wherein the controller is further configured or programmed to intermittently open and close the fuel injector during the air releasing control.

11. The outboard motor according to claim 1, further comprising:

an electric power storage; wherein the fuel pump is connected to the electric power storage; and during the air releasing control, the controller is further configured or programmed to open the fuel injector and drive the fuel pump with electric power from the electric power storage while the engine is stopped.

* * * * *